US006907893B2

(12) United States Patent
Eisenberg et al.

(10) Patent No.: US 6,907,893 B2
(45) Date of Patent: Jun. 21, 2005

(54) APPLIANCE FOR TREATING ARTICLES, PARTICULARLY NURSING BOTTLES AND ACCESSORIES

(75) Inventors: Avi Eisenberg, Kibuz Degania B (IL); Yechiel Weinstein, Moshav Atzmon (IL)

(73) Assignee: Bay-B Research and Development Ltd., Petach-Tikva (IL)

( * ) Notice: Subject to any disclaimer, the term of this patent is extended or adjusted under 35 U.S.C. 154(b) by 10 days.

(21) Appl. No.: 10/408,682

(22) Filed: Apr. 7, 2003

(65) Prior Publication Data

US 2003/0188769 A1 Oct. 9, 2003

Related U.S. Application Data

(60) Provisional application No. 60/372,392, filed on Apr. 9, 2002.

(51) Int. Cl.[7] ..... B08B 9/08

(52) U.S. Cl. ..... 134/148; 134/153; 134/166 R; 134/169 R; 422/303

(58) Field of Search ..... 134/148, 153, 134/166 R, 56 R, 105, 108, 169 R, 160; 422/297, 298, 300, 302, 303

(56) References Cited

U.S. PATENT DOCUMENTS

| | | | | |
|---|---|---|---|---|
| 2,254,269 | A | * | 9/1941 | Clark et al. |
| 2,340,215 | A | | 1/1944 | Fowler |
| RE22,832 | E | | 1/1947 | Meyerson |
| 2,484,681 | A | | 10/1949 | Brewster |
| 2,613,130 | A | * | 10/1952 | Jewell et al. |
| 2,843,867 | A | | 7/1958 | Gray, Sr. |
| 2,877,778 | A | * | 3/1959 | Kirby |
| 3,058,276 | A | | 10/1962 | Palma |
| 3,585,362 | A | | 6/1971 | Hoogesteger |
| 3,683,944 | A | * | 8/1972 | Anderson et al. |
| 3,804,297 | A | * | 4/1974 | Jurjans |
| 3,910,761 | A | * | 10/1975 | Hopkikns |
| 4,132,084 | A | * | 1/1979 | Francisco-Arnold |
| 4,376,096 | A | | 3/1983 | Bowen |
| 4,406,297 | A | * | 9/1983 | Walton |
| 4,544,529 | A | | 10/1985 | Hoeck |
| 4,560,455 | A | | 12/1985 | Porta et al. |
| 4,768,534 | A | | 9/1988 | Anderson |
| 4,781,898 | A | * | 11/1988 | Jones |
| 5,277,875 | A | * | 1/1994 | Albright et al. |
| 5,344,622 | A | * | 9/1994 | Faddis et al. |
| 5,357,992 | A | * | 10/1994 | Yang |
| 5,419,348 | A | | 5/1995 | Kuta |
| 5,435,036 | A | | 7/1995 | Hedrick |
| 5,507,060 | A | | 4/1996 | Quimpo |
| 5,522,410 | A | | 6/1996 | Meilleur |
| 5,709,003 | A | | 1/1998 | Batch |
| 5,724,692 | A | | 3/1998 | Zhadanov et al. |

(Continued)

FOREIGN PATENT DOCUMENTS

| | | | |
|---|---|---|---|
| GB | 2 260 483 | | 4/1993 |
| GB | 2260483 | * | 4/1993 |

*Primary Examiner*—Frankie L. Stinson
(74) *Attorney, Agent, or Firm*—Frizhauf, Holtz, Goodman & Chick, P.C.

(57) ABSTRACT

Appliance (100) having a housing (101) of compact dimensions wherein articles, particularly nursing bottles (123, 179) and accessories (119), are treated inside a chamber (1). Treatment is achieved with dosed amounts of fresh water retrieved from a fresh water tank (7), by successive cycles of washing, rinsing, and sterilizing. The treatment cycles use additives and high-speed jets of heated liquid and of steam, which are filtered for repeated use. At the end of the treatment, liquids are purged to a wastewater tank (33). Self-treatment of the appliance is provided by use of the same treatment cycles. The appliance is independent of external water supply, portable and automatic for use in situ, where electricity supply is available.

21 Claims, 6 Drawing Sheets

U.S. PATENT DOCUMENTS 5,730,944 A * 3/1998 Peake
5,787,910 A 8/1998 Oda et al.
5,855,219 A 1/1999 Spencer
5,903,944 A 5/1999 Burrell
6,048,502 A * 4/2000 Easter
6,058,247 A * 5/2000 Lahey et al.
6,562,145 B2 * 5/2003 Duckett et al.

* cited by examiner

APPLIANCE FOR TREATING ARTICLES, PARTICULARLY NURSING BOTTLES AND ACCESSORIES

RELATED APPLICATION

The present application claims priority under 35 USC 119(e) of U.S. Provisional Application Ser. No. 60/372,392, filed Apr. 9, 2002, the priority date of which is claimed herein, and the entire disclosure of which is incorporated herein by reference.

BACKGROUND

The present invention relates to automatic appliances for washing articles, and more particularly, to an autonomous and portable automatic appliance for treating articles such as nursing bottles and their accessories, by washing, rinsing, and sterilizing.

Ever since infants are fed by nursing bottles, there is a need to wash these bottles and their accessories. Nursing bottles, also related to as baby feeding bottles, infant bottles and the like, are all referred to as bottles. The same term applies to both shorter and longer bottles. Accessories are defined as nursing nipples, or nipples, and nipple connectors, or connectors, for retaining the nipples attached to the nursing bottles. Nursing bottles are also called feeding bottles and baby bottles. The term article refers to a nursing bottle and its accessories.

In view of the need, many solutions have been proposed. Cleaning equipment of the kind divulged in U.S. Pat. No. 2,340,215 by Fowler, and in U.S. Pat. No. 5,419,348 by Kuta, are not considered relevant since they are intended for the cleaning of bottles in industry. Solutions which do not provide automatic cleaning are disregarded, such as a manual brush disclosed by Batch, in U.S. Pat. No. 5,709,003, and a rigid spout penetrating inside the bottle, as taught by Spencer in U.S. Pat. No. 5,855,219.

Brushes and other disposable are not desirable, as they wear out and have to be replaced. Therefore, the following inventions are not believed to satisfy the need: U.S. Pat. No. 5,435,036 by Hedrick et al., U.S. Pat. No. 5,903,944, to Burell, U.S. Pat. No. 5,724,692 by Zhadanov et al., U.S. Pat. No. 5,507,060 by Quimpo, and U.S. Pat. No. 5,787,910 by Oda et al.

The necessity to couple a bottle cleaner to the water mains, thus to a water pipe, and the need to discharge spent water to a drain, is an unwanted limitation. Therefore, the invention of Anderson, for a portable cleaning apparatus described in U.S. Pat. No. 4,768,534 and that of Meilleur, for a portable single cup washer disclosed in U.S. Pat. No. 5,522,410, do not present a solution to the quest.

In U.S. Pat. No. 4,544,529, Hoeck teaches a bottle sterilizer, but not more than that.

What is required is an appliance of compact dimensions, performing automatically as an autonomous device. Autonomous refers to the independence from an external fixed water source such as a water supply in the form of a water pipe, water faucet and the like, all considered as water mains. Furthermore, the appliance should treat at least one single load of articles, such as a nursing bottle and accessories, and provide rinsing, washing, and sterilization cycles. Preferably, the appliance should be portable, independent from connection to a drain for the purging of spent water, and use but limited quantities of water, to permit treatment of more than one single load of articles.

SUMMARY

Articles such as emptied nursing bottles often present sticky residues clinging to their inside walls as well as to their accessories, e.g. feeding nipples and nipple connectors. It is a chore to clean those items day in, day out, and even then, they are only rinsed and washed, but not sterilized.

At home, and especially when traveling away from home, it is usually not possible to couple an appliance to water mains and to a drain, which are usually not available neither in every room at domicile, nor and in say, a hotel room. Even in a household kitchen, it is often not practical or straightforward to couple an appliance to water mains and to a drain. The same applies to situations outside the house or in the field. However, an electricity outlet, such as a socket in the wall or a cigarette lighter in a car, is commonly at hand.

Therefore, an automatic and portable autonomous nursing bottles treatment appliance that can be placed anywhere in the house or in the kitchen space, and requiring but a limited amount of wash water, is of advantage.

The solution disclosed is a portable housing of compact dimensions wherein a limited amount of water is reprocessed for use in a sequence of operations ranging from rinsing, washing and sterilizing to self-treatment. A limited amount of water is defined as the capacity of one nursing bottle, and is sufficient for full treatment of at least three soiled nursing bottles.

The appliance holds separate fresh water and wastewater tanks for the purpose of remaining independent from connection to water mains and drains, and has a treatment chamber containing the articles to be treated. Used water returns to the bottom of the chamber from where it is filtered and pumped back into the chamber as high-speed jets of water.

In operation, a dose of water is injected at high speed into the inside and the outside of the bottles as well as on the accessories. Repeated intermittent jets of hot water and detergent provide for complete washing and cleaning, while steam is generated for sterilization.

The invention provides a portable automatic appliance independent from external water supply, such as connection to water mains, permitting at least three cycles of treatment for a plurality of bottles before need to be supplied with fresh water. Wastewater is emptied when convenient. Besides water and additives, disposables such as brushes, are not required. Furthermore, a user may have the option to select a single cycle out of rinsing, washing, sterilizing and self-treatment, or a pre-programmed combination of cycles.

It is an object of the present invention to provide a portable compact appliance (100), performing automatically and independent of external water supply for the treatment of at least one single load of articles, particularly nursing bottles (123, 179), and accessories (119), wherever a supply of electricity is available.

It is a further object of the present invention to provide treatment as successive cycles of washing, rinsing and sterilizing while using restricted doses of fresh water that are filtered for repeated use.

It is another object of the present invention to provide an appliance (100) with:

- a fresh water tank (7) filled with water for controllable retrieval therefrom of a plurality of successive restricted measured doses of fresh water for the treatment of the articles, and configured for permitting operation of the appliance independently of external water supply such as water mains,
- a dosing device located downstream of the fresh water tank (7) and configured for controllably releasing at least one dose of measured and of restricted volume of fresh water, a heater (13) downstream of the fresh water tank and controllably operative to heat fresh water for treatment of the articles, a chamber (1) for the treatment of articles therein, the chamber being in fluid flow communication with and downstream of the dosing device, a spent water tank (33) coupled in fluid flow communication with and downstream of the chamber for collecting spent water, for permitting operation of the appliance independently of a drain pipe to a sewage system, whereby the appliance is autonomous for treatment of articles by being self-sufficient in fresh water supply and in spent water collection.

The dosing device is selected as a dose holder, a dosing valve, or a dosing pump.

It is yet a further object of the present invention to provide an appliance (100) where the dosing device is a dose holder (11), and the heater (13) is nested within the dose holder (11) and controllably operative to heat a dose of fresh water received inside the dose holder.

It is yet another object of the present invention to provide an appliance (100) where the treatment of articles has:

a washing treatment cycle, where fresh water is either one of both unheated or heated to temperature, and released, accordingly, as unheated water and as hot water for washing, a rinsing treatment cycle, where the heater remains either one of both operative and inoperative and water is released respectively, heated and unheated, as a fluid for rinsing, and a sterilization treatment cycle, where fresh water is heated to produce and release steam as a fluid for sterilization, whereby articles in the chamber are treated in either one of both a single and a plurality of treatment cycles, selected alone, and in combination, and in desired order, from the group of treatment cycles consisting of washing with hot water, rinsing with water, and sterilizing with steam.

It is furthermore an object of the present invention to provide an appliance (100) for treating a nursing bottle (123, 179) defining a nursing bottle length, a nursing bottle outside, and a nursing bottle mouth (169) leading to a nursing bottle inside, and the appliance further comprising within the housing:

a cage (3) received within the chamber (1) and configured for containing the articles inserted into the appliance for treatment, the cage being of cylindrical and of meshed construction to ensure fluid flow communication between the chamber and the articles and vice versa, and the nursing bottles being releasably retained inside the cage in predetermined equally spaced apart circular distribution in nursing bottle mouth-down orientation, and in controlled-looseness retention, a rotator (5) coupled to the cage for providing controllable cage rotation in continuous repetitive sequential steps of rotation and of dwell, the rotator advancing the cage in continuous repetitive sequential steps to one and to next dwell station and vice versa, with a dwell station for treatment of the accessories and of the outside of the nursing bottles, and a dwell station for treatment of the inside of the nursing bottles, whereby continuous rotation of the cage provides enhanced treatment of the accessories and of both the outside and the inside of the nursing bottles.

It is moreover an object of the present invention to provide an appliance (100) wherein within the housing there are:

a jet dispenser (25) downstream of and in fluid flow communication with the chamber, and receiving via the chamber of a succession of doses of fluid supplied thereto for controllably generating at least one intermittent high-speed jet of fluid for injection into the cage, the jet dispenser being aligned in operative association opposite the cage in oblique orientation relative to the length of a nursing bottle, to inject the at least one jet of fluid for treatment of the inside of a nursing bottle via the nursing bottle mouth when at a one appropriate dwell station, and to inject jets of fluid for treatment of the outside of the nursing bottles and of the accessories when at a next appropriate dwell station, whereby doses of fluid and intermittent at least one high-speed jet of fluid save fresh water and enhance treatment efficiency, and a filter (17) mounted intermediate the chamber and the jet dispenser, for filtering fluid received from the chamber before repeated use of filtered fluid by the jet dispenser, the filter enabling repeated use of a dose of fluid, whereby doses of fresh water necessary for treatment of articles are saved, permitting reduction of size of the fresh water tank and of the wastewater tank, to make the appliance portable.

If desired, the heater is located at either one of both inside the jet dispenser and adjacent the jet dispenser.

It is still an object of the present invention to provide an appliance (100) with:

at least one high-speed intermittent jet of fluid impinging obliquely inside a nursing bottle causing longitudinal displacement and angular displacement in perpendicular to the length of the nursing bottle, whereby successive at least one high-speed jet of fluid impinges successively on different spots inside the nursing bottle and enhance treatment. The jet dispenser may also be configured to generate a plurality of high-speed jets of fluid selected alone and combination from the group of intermittent and of continuous jets of fluid.

According to other features in the described preferred embodiments, the housing also has a controller (C) for commanding, controlling and sequencing operation of the appliance, where the controller is programmable to command automatic operation of the appliance in treatment step parameters, selected alone or in combination from the parameters consisting of order of successive treatment cycles, number of treatment cycles, and duration of treatment cycles.

According to further features in the described preferred embodiments, a volume of water ranging between 0.5 liter and 0.75 liter is retrieved out of the fresh water tank and sufficient for treatment of up to five articles. The appliance (100) is operable by electric power derived from a power supply, and is operable in situ wherever at least either one of both an appropriate electric socket and a suitable battery is available.

According to still further features in the described preferred embodiments, the fresh water tank (7) comprises a closable opening for refill, or is removable from the appliance and replaceable. The fresh water tank is filled with a liquid, such as water or with a treatment solution.

According to still other features in the described preferred embodiments, an external water supply, such as a water pipe from a water supply mains is coupled to the appliance to supply fresh water thereto, and a drain pipe to a sewage system is coupled to the appliance for receiving spent water therefrom, whereby the appliance is operable for the treatment of articles in static counter-top appliance configuration.

According to yet other features in the described preferred embodiments, at least one additive is controllably released from at least one additive container (27) which is coupled in fluid flow communication and appropriately configured for addition of the at least one additive for the treatment of articles, whereby the treatment of articles is enhanced. The at least one additive is a washing enhancement additive selected as a detergents or a soap, or a disinfectant.

According to additional features in the described preferred embodiments, the appliance is operative for the treatment of at least one article by sole consumption of water and at least one additive, whereby disposables, such as at least one brush, are superfluous and unnecessary.

According to other additional features in the described preferred embodiments, the appliance operates a self-treatment process which is controllably operative and has one or more treatment cycles, selected from the treatment cycles of washing with either one cold and hot water, of rinsing with either one cold and hot water, and of sterilizing with steam, in a selectable order and number of cycles.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION

In the description below, nursing bottles, also related to as baby feeding bottles, infant bottles and the like, are all referred to as bottles. The same term applies also to shorter and to longer bottles, as described below. The term article is used not only for bottles but also for their accessories, defined as feeding nipples and nipple connectors, which are not described since they are well known. Bottles, of various lengths, with a bottle mouth, bottom interior, bottle body, and bottle exterior, are also well known and are not described.

Furthermore, baby-feeding utensils, for example baby feeding spoons may also be regarded as articles. However, the appliance is easily customized for other articles such as test tubes, various kinds of bottles and containers, instruments for medical and veterinary purposes, and the like. Moreover, the appliance is configured for field use, thus for use outside in the open, provided electricity is available.

Figure 1:
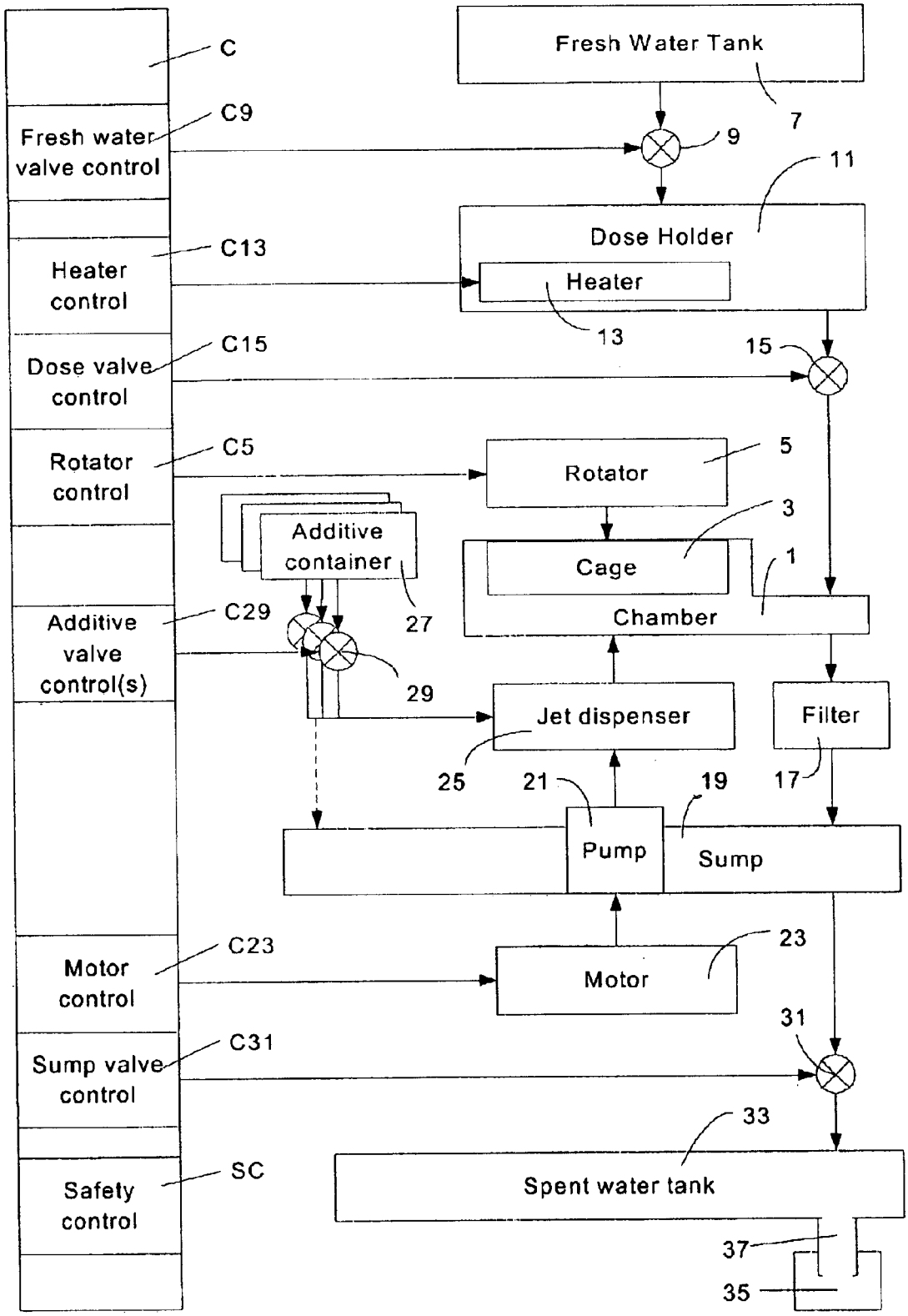
FIG. 1 is a functional block diagram illustrating the main functional elements of the appliance.

FIG. 1 is a functional block diagram illustrating the main functional elements of the appliance. An external housing of compact dimensions (not shown in FIG. 1) encloses therein the various component of the appliance The articles, not shown in FIG. 1, are washed, rinsed, and sterilized inside the chamber 1, while being retained in a cage 3 received inside the chamber 1. When the appliance is in operation, the cage 3 is coupled for continuous steps of angular rotation and dwell, performed by a rotator 5, which is controlled by a rotator control C5.

Water for treating the articles is supplied from a fresh water tank 7, internal to the housing but external to and upstream of the chamber 1, coupled via a fresh water valve 9 to a dose holder 11, configured for holding a metered and restricted measured volume or dose of fresh water. The operation of the fresh water valve 9 is supervised by a fresh water valve control C9. The dose holder 11 is an example of one possible implementation, but the appliance is operable without dose holder. A restricted and measured dose of fresh water is possibly delivered by the fresh water valve control C9 acting as a dosing valve or dosing device, or by a dosing pump, for delivery of one or more successive doses of fresh water. The dosing device or dose holder 11 is located downstream of the fresh water tank 7, and the chamber 1 is in fluid flow communication with and downstream of the dose holder.

A heater 13, powered by electricity to heat water and accommodated inside the dose holder 11, is operated by a heater control C13. The heater 13 is turned on and off according to the setting commands of the controller C13, to heat the water to various levels of temperature, ranging from unheated water, when the heater is turned off, to hot water, and to steam, when the heater 13 is turned on. Although not shown in FIG. 1, the heater 13 is not necessarily mounted inside the dose holder 11, but is always located downstream of the fresh water tank 7.

A dose of fresh water is released from the dose holder 11 via a dose valve 15, to the inside of the chamber 1, from where it flows down by gravity via a filter 17, into a sump 19. The dose valve 15 is operated by a dose valve control C15.

The sump 19 holds a pump 21, operated by an electric motor 23, which is commanded by a motor control C23. When the motor control C23 orders operation of the motor 23 to drive the pump 21, water is pumped from the sump 19 into a jet dispenser 25, where high-speed jets of water generated by the pump 21 are directed to the inside of the cage 3, via the chamber 1.

The jet dispenser 25 is thus located downstream from and in fluid flow communication with the chamber 1, and receives therefrom of a succession of doses of fluid supplied thereto for controllably generating intermittent high-speed jets of fluid for injection into the cage 3.

An additive container 27 holding a substance, such as a detergent for enhancing washing, is also coupled to the jet dispenser 25, via an additive valve 29, which is steered by an additive control C29. The additive is added to the water for treating the articles contained inside the chamber 1. Optionally, the additive is added directly to the sump 19 instead of to the high-speed water jets in the jet dispenser 25. Furthermore, there may be more than one additive for enhancing washing, such as an additive for disinfection. For self-treatment of the appliance, possible additives are a washing additive, a disinfection additive, a descaling additive, and the like. For each additive there is one additive container 27, which is coupled to one additive valve 29, coupled in turn, to one additive control C29.

Water jets from the jet dispenser 25, pointed toward the open bottom opening of the chamber 1, with or without additive(s), enter the chamber 1, impinge on the inside and on the outside of the articles to be treated, and flow down by gravity through the filter 17, to return to the sump 19. From the sump 19, the water is used again, in a repeated cycle lasting for a predetermined extent of time. When commanded, the spent water is released from the sump 19 by opening of a sump valve 31, supervised by a sump valve control C31, for discharge into a spent water tank 33. The spent water tank 33 is coupled in fluid flow communication with and downstream of the chamber 1, via the sump 19.

The filter 17 which is mounted intermediate the chamber 1 and the jet dispenser 25, filters fluid received from the chamber before repeating use of filtered fluid by the jet dispenser. The filter 17 thus enables repeated use of a dose of fluid, whereby doses of fresh water necessary for treatment of articles are saved, permitting reduction of the size of the fresh water tank 7 and of the spent water tank 33, to make the appliance portable.

It is noted that the appliance is operable with the heater turned either on or off at different occasions in the same treatment cycle. For example, the dose holder 11 may release unheated water to the sump 19, for rinsing the articles contained in the chamber 1, when operated in a rinsing cycle, but may use heated water in another rinsing cycle. Likewise, the dose of water delivered to the sump 19 may be heated by the heater 13, for better cleaning of the articles, when working in a washing cycle, or may not be heated when in a different washing cycle. Furthermore, when the dose of water is transformed to steam by the heater 11, the articles in the chamber are subject to sterilization, as a further cycle. Preferably, the process for the treatment of articles is thus performed with hot water for washing, with unheated water for rinsing, and with steam for sterilization.

The heater 13 is not necessarily nested inside the dose holder 11, but may be located inside, below, adjacent or to the side of the jet dispenser 25 or of the sump 19.

When a drain is available, a plug 35 is removed from a discharge pipe 37 attached to the bottom of the spent water tank 33, and a hose, not shown in FIG. 1, is possibly coupled to the discharge pipe 37. The hose serves to transfer spent water from the spent water tank 33 via the discharge pipe 37, to a drain. Evidently, removal of the plug 35 permits to discharge spent water into a sink, lavatory, and wherever desired, without the need for a hose. Other methods for discharging spent water from the spent water tank 33, such as a retractable hose are also possible. The spent water tank 33 is possibly configured for easy removal, to allow a user to empty it manually into a sink.

The above-mentioned operations are all controlled by a control unit, generally designated as C in FIG. 1, containing control components such as the fresh water control C9, the heater control C13, the dose valve control C15, the rotator control C5, at least one additive control C29, the motor control C23, the sump valve control C31, and a safety control CS. The control unit C also provides safety locks operated by the safety control CS, not described below, to ensure the operation of the appliance in a safe and hazard-free manner. The sensors supporting operation of the safety locks, such as temperature sensors, are not described. For example, such locks may prevent operation of the heater in the absence of water in the dose holder 11, and preclude opening of the chamber 1, while the appliance operates, or when in the presence of high temperature. The control unit C, configured for distributed or for centralized control, well known to the art, is not described.

The appliance described above, is portable, due to restricted and compact housing dimensions, and since equipped with a fresh water tank 7 and a waste water tank 33, is self-sufficient and autonomous regarding external water supply and waste water disposal, and operable in situ wherever a supply of electricity is available. Electricity form a socket, thus from electricity mains, or from a battery, such as from a vehicle, are practical supplies of electricity.

If desired, the appliance is possibly connected to a water pipe attached to fresh water supply mains, and to a drainpipe leading to a sewage system, to become a static counter-top appliance for the kitchen, laboratory and the like.

The appliance is described in more detail below, with respect to FIGS. 2 to 6, to illustrate the construction of one embodiment 100, in accordance with the functional block diagram depicted in FIG. 1. Similar reference numerals refer to similar elements in the various Figs.

Figure 2:
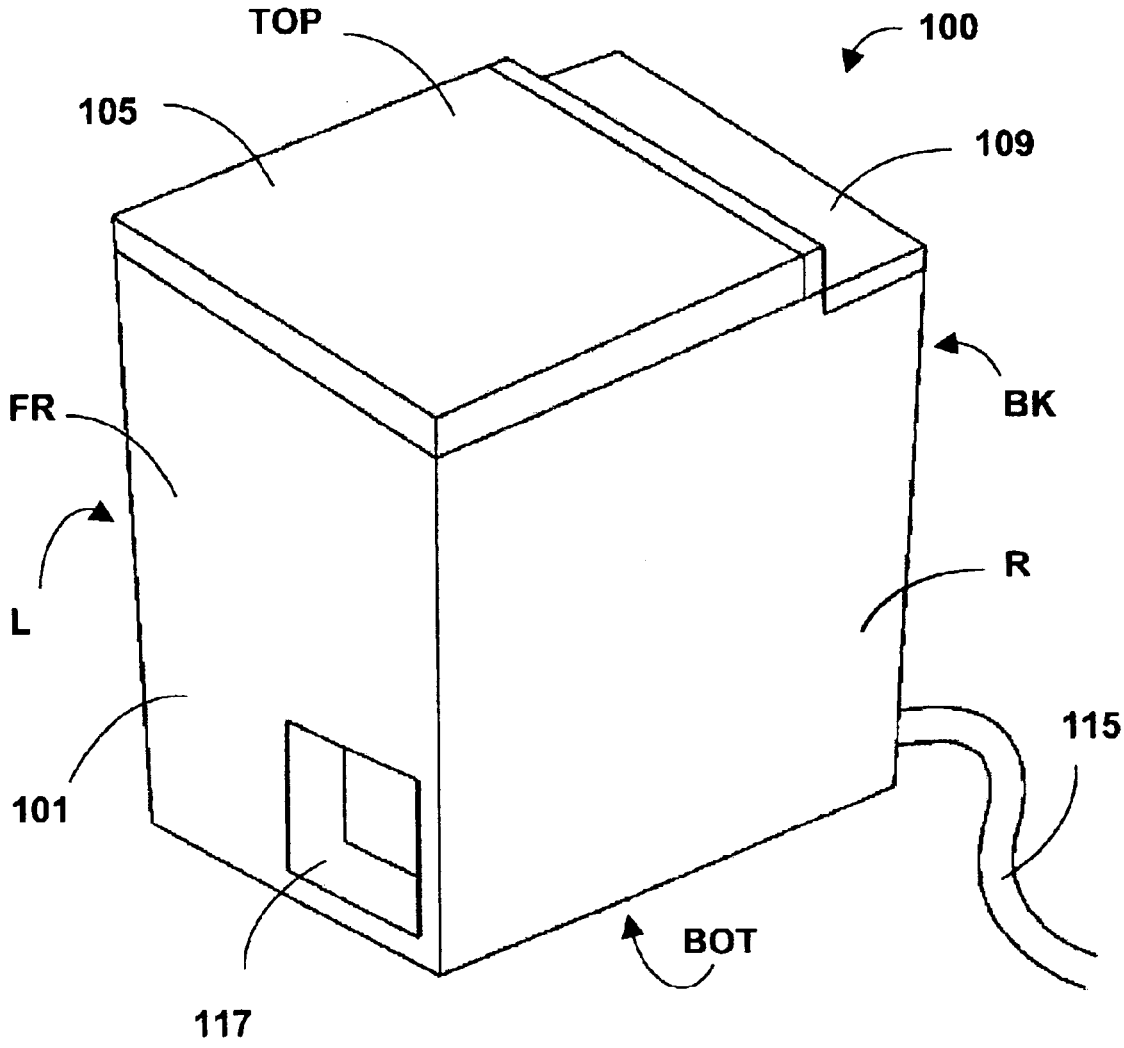
FIG. 2 presents a view of the appliance as illustrated in FIG. 1.

For the sake of orientation, FIG. 2 shows the generally orthogonal parallelepiped shape of the appliance, with the designations TOP and BOT, respectively for the top and the bottom of the appliance, as well as FR and BK for the front and the back thereof. The side of the appliance seen in FIG. 2. is the right side, or R, while the opposite side, thus the left side, is called L.

Figure 3:
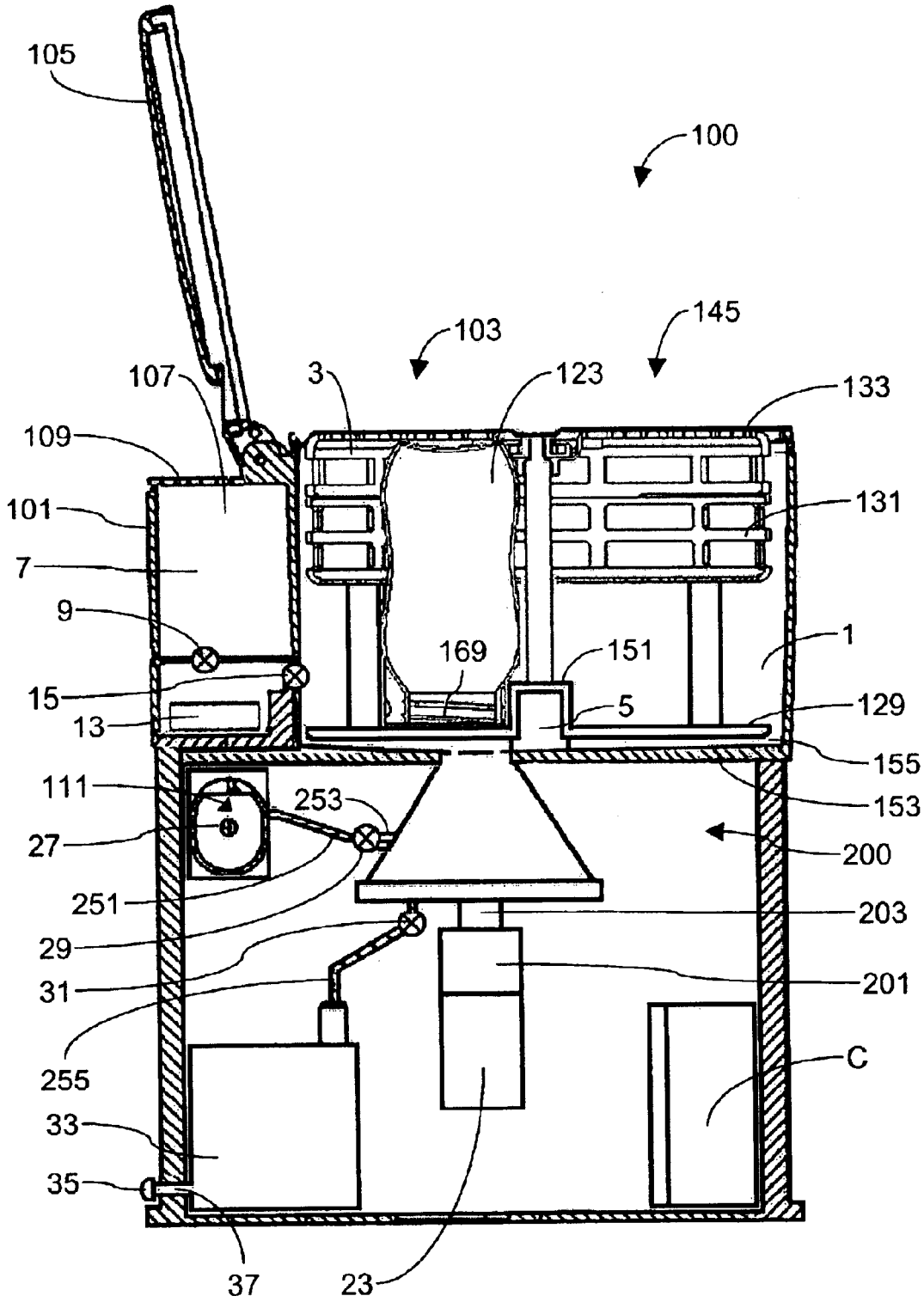
FIG. 3 is a cross-section showing the inside of the appliance holding the elements illustrated in FIG. 1.

As shown in FIGS. 2 and 3, the embodiment 100 of the appliance has a housing, generally designated 101, formed with an inlet opening 103 through which the articles to be treated are introduced, and later removed after treatment. A pivotal lid 105 overlies the inlet opening 103. The lid 103 is pivoted by hand, either to its open position for introducing the articles to be treated, or to its closed position. Any other type of openable and closable lid will suffice.

The term treatment or cleaning is used to define the various cycles of operation of the appliance 100, ranging from washing, through rinsing, and to steam sterilizing. Self-treatment of the appliance, by washing, rinsing, and sterilizing, is an additional feature related to periodical maintenance.

As further shown in FIGS. 2 and 3, the housing 101 also includes a water inlet opening 107 hidden below a closed but openable watering lid 109, for filling water into the fresh water tank 7 of the appliance, an additive inlet opening 111 hidden by a closed but openable additive lid 113, not seen in the Figs., for the addition of additive into the additive container 27 of the appliance, and the plug 35, in the back of the appliance, removable from the discharge pipe 37. If desired, it is possible to connect a hose to the discharge pipe 37, to purge spent water from the spent water tank 33. Otherwise, the plug 35 is removed and the appliance is emptied into a sink, a lavatory, or elsewhere.

The fresh water tank is evidently refillable with liquid other than water, such as a dedicated treatment solution. As an alternative, the fresh water tank 7 is implemented as a separate container, removable and replaceable as a unit, such as a bottle of water. The spent water tank 33 and the additive container(s) 27 may also be implemented as removable and replaceable units.

In FIG. 2 there is further shown an electrical cable 115, for supplying electrical power to the appliance, and a user interface 117, or control panel 117, in the front F, with a display panel if desired, permitting a user to input various commands, for control of the operation of the appliance. Besides starting and stopping, there is provided, for example, a selection of cycles and of treatment sequences, a start time, and a duration of treatment.

As further shown in FIG. 2, the inlet opening 103 normally covered by the pivotal lid 105, is located at the top TOP of the housing 101, to permit convenient introduction of the articles to be treated. The water inlet opening 107, normally closed and hidden below the openable watering lid 109, is located to the back BK of the pivotal lid 105, also at the top TOP of the housing 101, to facilitate water refill. The additive inlet opening 111, usually closed and hidden from view by the openable additive lid 113, is positioned at mid-height, on the left side L of the appliance, but is not shown in FIG. 2. In turn, the plug 35 and the discharge pipe 37 are located on the back BK of the appliance.

The treatment of the articles is performed within the housing 101, and includes a single or more cycle(s) for washing the articles without unheated water or with hot water, without or with at least one additive, such as soap or a detergent, rinsing with unheated or with hot water, and for steaming in a sterilization treatment cycle. The term fluid is used below to relate to both water and steam, and the term detergent refers to soap and to detergent.

FIGS. 3 to 6 more particularly illustrates the internal structure of the appliance for performing the treatment cycles. Similar reference numerals and characters refer to similar elements in the various Figs.

As shown in FIG. 3, the housing 101 includes the treatment chamber, generally designated as 1. The cage 3 is rotatively supported inside the chamber 1, to retain articles such as the accessories 119 and the bottles 123. FIG. 3 depicts one bottle 123, in inverted position. The accessories 119, e.g. nursing nipples 125 and nipple connectors 127, are not shown in the Figs. The cage 3, which is a generally cylindrical skeletal meshed structure, is designed to facilitate the passage of fluid therethrough, and if desired, is possibly configured for removal out of the inlet opening 103, for loading of the articles therein, and after loading is completed, for return into the chamber 1 via the inlet opening. If desired, the cage 3 is built-in and not removable.

Figure 4:
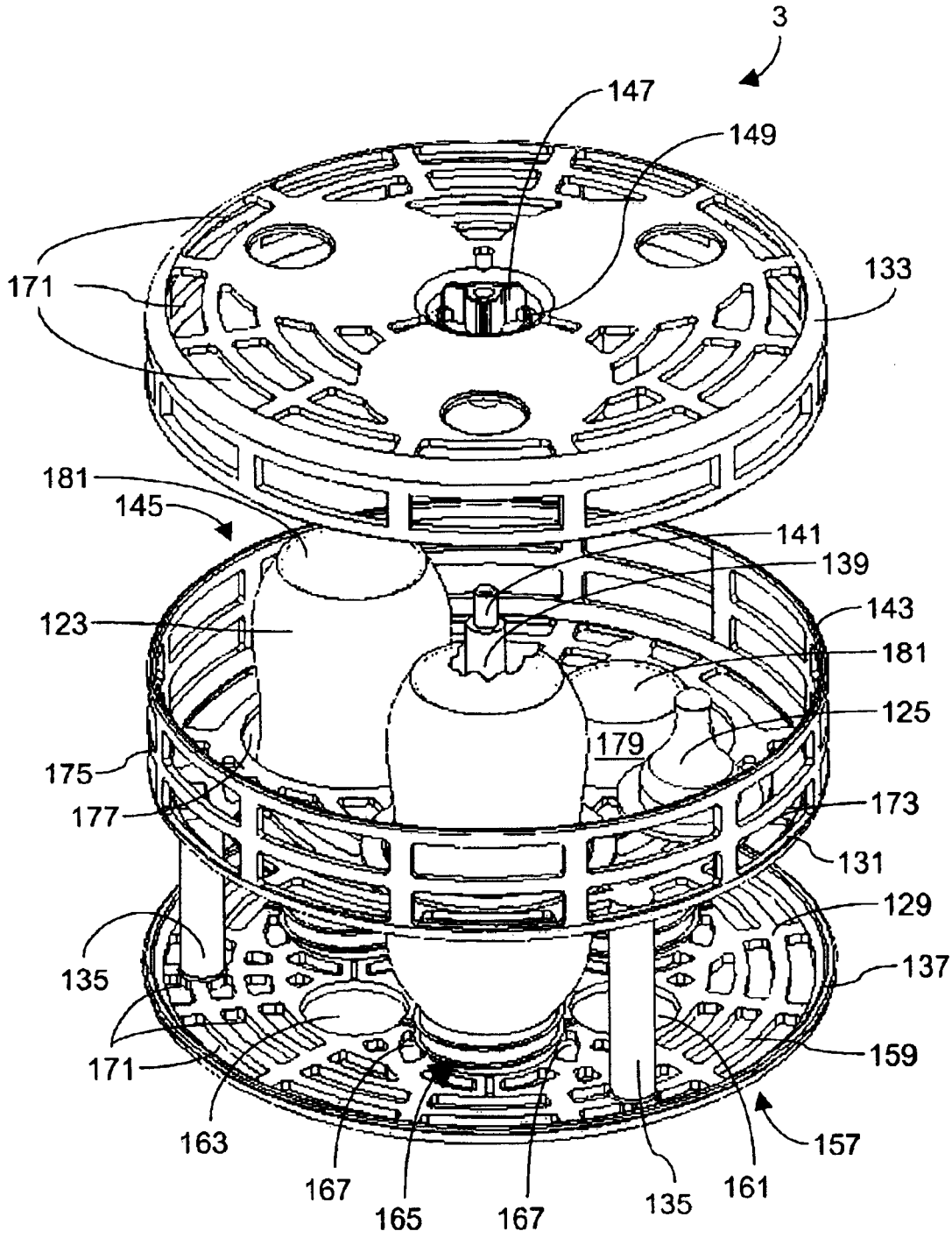
FIG. 4 depicts details of the cage retained inside the treatment chamber shown in FIGS. 1 and 2.

With reference to FIG. 4, the cage 3 features three horizontally parallel circular levels all meshed with voids intended to ease the passage of fluid. A tray 129 is located at the lowest level, with a basket 131 at mid-level, and a cage lid 133 at the upper level. Three vertical rods 135, of which only two are seen in FIG. 4., are equally distributed adjacent the rim 137 of the tray 129, and fixedly couple the basket 131 and the tray 129 at distance from each other.

An axial vertical shaft 139, concentric to the cage 3, is firmly attached to the tray 129 and to the basket 131, but has a shaft tip 141, which freely passes to protrude through and slightly above the cage lid 133, when this last one is closed on the basket 131. The axial vertical shaft 139 thus rises from the center of the tray 129 to exit at about the level of the basket rim 143, which defines the loading opening 145 of the basket 131, and is located at the center thereof.

A retaining element 147, fixedly secured within a concentric depression 149 entered at the center of the cage lid 133, engages the axial vertical shaft 139 in releasable manually operated lock thereon. When the cage lid 133 is lowered to cover the loading opening 145 and the retaining element 147 is locked on the vertical shaft 139 then the cage 3 becomes a single closed unit. When the cage 3 is removable, it may be lifted out, and returned into the chamber 1, as a single unit. Usually, the cage 3 is gripped by the retaining element 147 at the center of the cage lid 133, or by any of the many meshes or openings accommodated therein.

As seen in FIG. 3, the tray 129 is generally flat but for a cylindrical protrusion 151, lifted above the surface of the tray 129. The cylindrical protrusion 151 is hollow and coaxially supports the axial vertical shaft 139. It is within the hollow inside of the cylindrical protrusion 151 that the rotator 5 is housed.

When the cage 3 resides in the chamber 1, the hollow inside of the cylindrical protrusion 151 mates with the rotator 5 on which it comes to rest. When commanded to operate by the control unit C, the rotator 5 actively revolves the cage 3 stepwise through a predetermined angle and then, stops for a dwell at a dwell station. It is during a dwell station that most of the treatment of the articles takes place. The rotator 5 consecutively repeats the cage rotation in continuous repetitive sequential steps of rotation and of dwell, until commanded to stop by the control unit C. The rotator 5 is possibly selected as a rotating solenoid, a step motor, or the like.

The rotator 5 is supported by a partition 153, which is a portion of the housing 101, adjacent and generally parallel to the tray 129 but in slight conical depression for liquid to flow towards the filter 17. It is noted that the chamber 1 is cylindrical, to conform with the cage 3, and has a chamber bottom 155 opposite to the loading opening 103, which is in fact the top opening of the chamber 1.

The cage 3 presents open meshes attached to each other, with more open passages than material, to allow the penetration of jets of fluid oriented to impinge on the articles retained therein. Those jets of liquid and steam are directed to pass upward, from the underside of the tray bottom 157, over the tray top 159 and up toward the basket 131, through openings of the tray 129, to penetrate and to treat the outside and the inside of inverted bottles 123, as well as accessories 119.

The flat surface of the tray 129 concentric to the cylindrical protrusion 151 is pierced, in this example for an appliance for the treatment of three bottles 123 and accessories 119, with six equally distributed passage apertures 161, mutually at 60° of each other. The passage apertures 161 are preferably of circular shape, or of any other practical shape. The passage apertures 161 are thus concentric to and surround the vertical shaft 139 of the cage 3, and are all distributed on the same diameter. The passage apertures 161 are arranged to form three successive couples of openings, each couple with namely, one free aperture 163 adjacent to one bottle aperture 165. When loaded with articles, each one of the three bottle apertures 165 is capped by an inverted bottle 123, for jets of fluid to penetrate to the inside thereof, whereas the three remaining free apertures 163 allow the jets of fluid to hit the outside of the bottles and the accessories 119.

The minimal number of passage apertures 161 in the tray 129 is equal to twice the maximal number of bottles 123 that the appliance is designed to treat. An appliance for the treatment of one bottle will thus need a tray 129 with at least one bottle aperture 165, and one free aperture 163. For two bottles 123, the minimum will be two free apertures 163 and two bottle apertures 165. It is noted that apertures of any shape are practical, and that the bottle apertures 165 are as large in diameter as possible while still providing support to inverted bottles 123.

On the tray top 159, the circumference of each bottle aperture 165 is surrounded by centering protrusions, such as at least three equally spaced centering fingers 167. The fingers 167 are guides protruding upward from the tray top 159 for loosely centering a bottle mouth 169 of a bottle 123 in axial alignment over a bottle aperture 165. During treatment, a bottle 123 is thus free to slightly lift upward and away from the tray top 159 and to rotate along its length, as described below.

Besides the passage apertures 161, the tray 129 is meshed with as many voids 171 as possible for the passage of fluid therethrough, and so are the basket 131 and the cage lid 133.

The basket 131 presents a generally cylindrical shape with a basket bottom 173 having a substantially flat surface, from the circumference of which raises a cylindrical basket sidewall 175 that forms a fence about as high as the height of a feeding nipple 125. The top of the basket sidewall 175 forms the basket rim 143, which defines the circular basket loading opening 145. In addition, the basket bottom 173 is perforated with voids 171 for the free passage of fluid.

Bottle passages 177 are entered into the bottom 173 of the basket 131, for the insertion therethrough of bottles that will rest come to rest on the tray 129. There are as many bottle passages 177 as the number of bottles that the appliance 100 is intended to treat. For an appliance 100 with a capacity of three bottles, the bottle passages 177 are entered with an equal spaced apart distribution of 120°, on the same diameter as the passage apertures 161. The bottle passages 177 generally conform the outside of the bottles 123 and provide clearance sufficient for small lateral displacements of the bottles.

The bottle passages 177 are aligned with and opposite each one of the bottle apertures 165 opened in the tray, so that bottles 123 passed in inverted position into the loading opening 145, via the bottle passages 177, will match the bottle aperture 165.

The vertical distance between the tray 129 and the basket bottom 173 is about half the height of a bottle 123, but lower than the length of a short-sized, short-length, or short bottle 179. The intention is to take advantage of the bottle passages 177 to restrict sideways motion of both full-length bottles 123 and short-length bottles 179.

The basket loading opening 145 is closed at the top by the cage lid 133, to retain the articles therein. The voids 171 are small enough to prevent the exit of the accessories 119, such as feeding nipples 127, and nipple connectors 127, and even of smaller items.

The bottles 123 and 179 are loosely retained inside of the cage 3 but restrained laterally by the centering fingers 167 and the bottle passages 177, and longitudinally by the cage lid 133. The cage lid 133 is high enough above the tray top 159 to permit centering of a bottle 123 or 179 inside the centering fingers 167 and closing of the cage lid 133 while still leaving some axial clearance to the bottle. However, that clearance is shorter than the height of protrusion of the centering fingers 167 above the tray top 159. Therefore, a bottle 123 is free to rotate and to lift upward, but will be arrested by the lid 133 before exiting the centering fingers 167.

For the treatment of a mix of standard length, or full-size bottles 123, together with short bottles 179, an interface element such as a down-pointing vertical component descending from the cage lid 133 toward the basket 131, is added. Such an interface element is possibly a rod of adjustable or of fixed length, not shown in the Figs., descending from the cage lid to just over a bottle bottom 181, for short bottles 179. Both sizes of bottles are thus retained in controlled-looseness inside the cage 3, being able to lift slightly up and to rotate along their length. Since both types of bottles 123 and 179 are retained and treated in the same manner, reference will be made below to full-length bottles 123, it being clear that the same applies to short-length bottles 179.

The bottles 123 and 179 are thus retained inside the cage 3 in vertical inverted position, each one opposite a bottle aperture 165, without the risk of toppling over, and with their respective bottle bottom 181 pointing upward. The accessories 119 are inserted into the basket 131 in random distribution, into which basket they are restricted since being larger than the voids 171. In case the appliance 100 is operated below full bottle treatment capacity, then the bottle passages 177 not occupied by a bottle 123 are obstructed, fully or preferably partially, both obstructions not shown in the Figs. Possibly such an obstruction may consist of a clean bottle, a dummy bottle, a plug, or a passage barrier sufficient to prevent exit of the accessories 119 from the basket 131.

The above-described cage 3 is easily reconfigured for the treatment of bottles 123 of various shapes and sizes, besides bottles with one specific circular cross-section. For one particular type of bottles 123, not shown the Figs. but different from the bottles with one specific circular cross-section, it suffices to match the bottle apertures 165 and the bottle passages 177 to the external shape and dimensions of the particular type of bottle. Furthermore, the centering fingers 167 have to fit the bottle mouth 169.

If desired, one cage 3 is configured to accommodate more than one type of bottles 123. Moreover, since the cage 3 is removable from the chamber 1, it is possible to insert a selected cage 3 into the chamber 1, so that the cage will suit a certain type of bottle 123.

Figure 5:
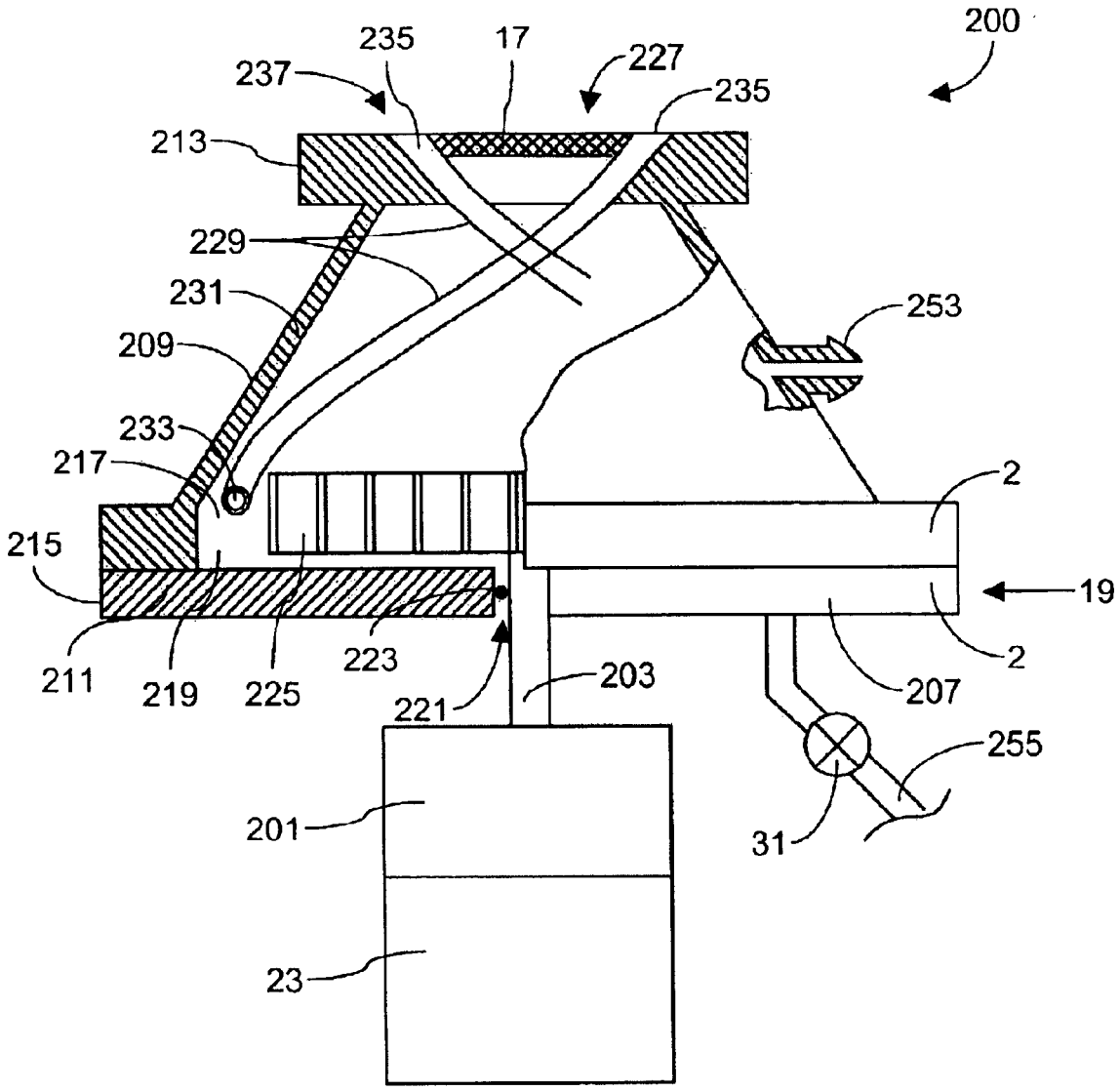
FIG. 5 shows the jet dispenser in more detail than in FIG. 2.

FIG. 5 illustrates in more details a cyclone assembly 200, with reference to the functional blocks of FIG. 1. When implemented, the functional blocks representing the motor 23, the pump 21, the jet dispenser 25, and the filter 17 are all vertically aligned on the same diameter concentric to the vertical axis of the cage 3 as are the passage apertures 161. The mechanism, by which the pump 21 collects fluid from the sump 19 for release as high-speed jets via the jet dispenser 25, and the elements implementing the pump 21, is described below.

The electric motor 23 is coupled via a transmission 201 to a rotor shaft 203, or optionally, coupled directly to a rotating element, which is a portion of the pump 21. In fact, the pump 21 is a centrifugal pump integrating an assembly combining the sump 19 and the jet-dispenser 25, all referred to generally as the cyclone assembly 200. It is appreciated that any other types of pump or jet creation system capable of generating high-speed jets of fluid is appropriate for the task.

The sump 19 is composed of a disk 207, flat and circular, atop which is concentrically aligned a shell 209 of substantially straight frusto-conical shape, with a disk flange 211 at the bottom and a filter flange 213 at the top, both flanges being perpendicular to the height of the shell 209. The disk 207 is fixedly attached and sealed to the shell 209 along the periphery 215 of the disk mating with the disk flange 211 and define a sump volume 217 at the bottom 219 inside the shell 209. At the center, the disk 207 is pierced by a central shaft bore 221 The rotor shaft 203 coupled to the motor 23 enters the disk 207 from below via the central shaft bore 221 and a seal 223 dynamically seals the sump 19. Both the sealed periphery, thus of the disk 207 and the shell 209 and the seal 223 prevent loss of liquid from the sump volume 217.

It is atop the rotor shaft 203, which enters the disk 207 from below to protrude above it, thus inside the shell 209 that a finned rotor wheel 225 or rotor 225 is mounted. The rotor 225 is horizontal, parallel, and adjacent to the disk 207. When liquid resides in the sump volume 217 the rotor 225 is partially or totally submerged.

The filter flange 213 atop the shell 209 extends radially outward and annularly around a shell opening 227 entered at the center of the filter flange, which is mounted opposite and above the rotor 225. It is by the filter flange 213 that the cyclone assembly 200 is fixedly attached to and below the partition 153.

The shell 209 and the rotor 225 form the jet dispenser 25, as described below.

Figure 6:
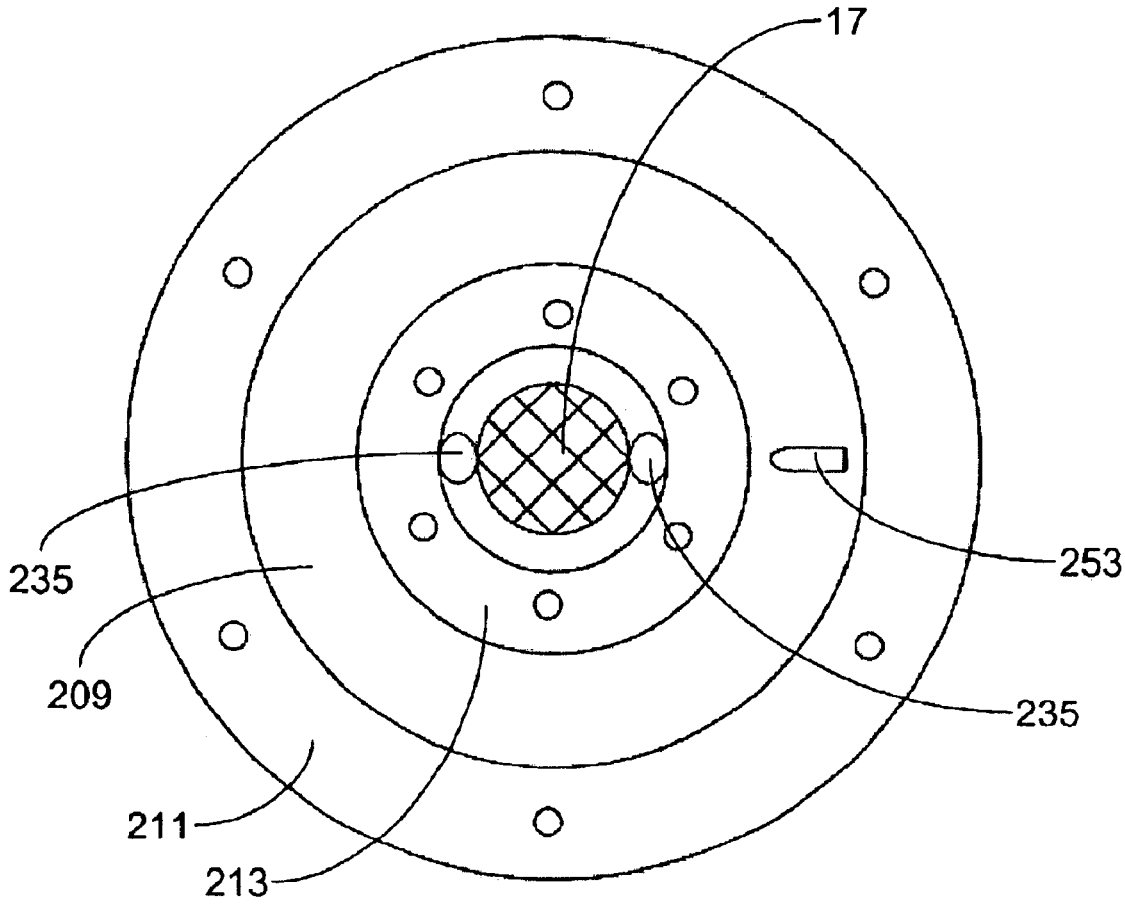
FIG. 6 is a top elevation of FIG. 5.

On the inside of the shell 209 two diametrically opposed conduits 229 of small circular cross-section are molded inside the thickness of the frusto-conical wall 231 of the shell 209 or in protrusion therewith. These conduits 229 ascend helically, each providing an open conduit inlet 233 starting from slightly above the disk 207 and leading to an open conduit outlet 235 ending at the top of the filter flange 213. There is thus provided a fluid communication path via each conduit 229 wherefrom fluid may exit in oblique to the vertical. It is between both conduit outlets 235 that the filter 17 is releasably inserted and retained concentrically, as best seen in FIG. 6.

The inner diameter of the conduits 229 is either constant or gradually decreasing to end in an exit nozzle 237, or spout 237, to further increase the velocity of flow of the fluid passing therethrough. The spouts 237 are not depicted in the Figs. but form the conduit outlets 235.

It is appreciated that as an alternative, the cyclone assembly 200, may feature but one conduit 229, thus with one conduit outlet 235, providing a single high-speed jet of liquid or of fluid. In contrast, three, four or more conduits 229 are feasible, to provide an according number of high-speed jets of liquid or of fluid.

It is further appreciated that in alternative implementations of the cyclone assembly 200, the conduits 229 may ascend symmetrically, asymmetrically, or independently, in various directions and gradients inside the shell 209. The method of ejection of intermittent slanted high-speed jets of fluid enhances the effectivity of the treatment, since those jets impinge on the bottles 123, inside and out, and may impact on the articles in different spots, at different heights, with different jet speeds and fluid quantities.

The cyclone assembly 200 provides axial alignment of the shell 209, and of the rotor shaft 203, which is directly coupled to the rotor 225. However, the finned rotor wheel 225 is possibly rotated by other coupling means besides the direct drive to the motor 25 described above. Furthermore, any other type of pump or of high-speed jet forming means may replace the cyclone assembly 200 described above.

To produce the exit in oblique of high-speed jet of liquid from the spouts 237 a dose of liquid gathered inside the sump volume 217 is first accelerated by the rotor 225 which is revolved at high speed by the motor 23. The dose of liquid, now in rotational spinning, climbs the inside wall 231 of the shell 209 where a small amount of liquid enters the conduit inlet 233 to exit from the conduit outlet 235, configured as spouts 237, as a forceful high-speed jet directed slantingly upward off the vertical. Continuous jets or intermittent jets result in accordance with the commands provided by the control unit C to the motor 23, requiring respectively, continuous or intermittent rotation of the rotor 225 However, pulsating intermittent high-speed jets of fluid are preferable since they achieve better treatment of the articles.

As a further alternative to enhance treatment, the orientation of the exit nozzles may be fixed, adjustable or even operating under preprogrammed control. Moreover, the exit nozzles, or guiding fins, may focus the jet of fluid or disperse it, to better suit increased effectiveness of treatment.

When the cyclone assembly 200 resides at a dwell station in alignment opposite a bottle aperture 165 opened in the tray 129 of the cage 3, and both a bottle 123 or 179 and the cyclone assembly are in vertical axial alignment bottle bottom 181 up, the oblique and intermittent high-speed jets of liquid impinge on a spot inside the bottle. It was stated above that the same phenomena and processes apply to full-length bottles 123 and half-length bottles 179. Since the bottle 123 is retained in controlled-looseness retention, limited lengthwise translation and furthermore rotation perpendicular to the length are possible, without retention being lost. An intermittent high-speed jet of liquid impinging on the inside of a not rigidly retained bottle 123 will cause some rotation and lifting, after which the bottle will fall back, and somewhat rotate the bottle in an angle of turn. The next intermittent high-speed jet of liquid will thus hit the inside of the bottle 123 at another spot, different from the previous one, and the process will repeat.

The limited rigidity of retention of a bottle 123, or controlled-looseness retention, permits movement of the bottle. When high-speed intermittent jets of fluid impinge obliquely inside a nursing bottle 123 or 179, they cause angular displacement in perpendicular to the length of the nursing bottle and a momentarily lift of the bottle, so that successive high-speed jets of fluid impinge successively on different spots inside the nursing bottle and enhance treatment.

Likewise, when a free aperture 163 comes in vertical axial alignment with the cyclone assembly 200, then the high-speed jets of fluid are forcefully shot upward to hit the external portion of the bottles 123, as well as accessories 119 inside the basket 131. In this case too, as described above, the bottles 123 are prone to limited translation and rotation.

It is noted that the accessories 119 are dispersed in random distribution inside the basket 131, where they are free to even rollover when hit by an intermittent high-speed jet of liquid, but are restrained to remain inside the basket.

Fins or vanes of any shape may be added to the tray bottom 157 or to the cyclone top portion 233, to orient the high-speed jets, either to focus or to disperse the jets, for better treatment of the outside of the bottles 123 and of the accessories 119.

With reference to FIG. 3, liquid flows back down from the cage 3 via the chamber bottom 155 and onto the partition 153, conically leading fluid toward the filter 17. It is by gravitation that spent liquid is filtered through the filter 17 and returned via the inside of the shell 217 to the sump volume 207, from where it is pumped for a further cycle of ejection out of the spouts 235, until the control unit C commands a stop. The filter 17 thus permits repeated use of the same dose of fresh water, saving on water consumption whereby the capacity of the fresh water tank 7 is reduced, but still contains enough liquid for treating more than one load of articles, and nevertheless provide for a portable appliance 100.

When high-speed jets of unheated water are desired, such as for rinsing, then the control unit C prevents operation of the heater 13, accommodated inside the dose holder 11, or elsewhere. However, for hot washing liquid, the heater 13, supervised by the control unit C, heats fresh water or any other liquid contained inside the fresh water tank 7, which is released when at the appropriate temperature. Similarly, when steam is required for sterilization, the heater 13 transforms a dose of fresh water released by the fresh water control valve 9, into steam, which then reaches the sump volume 207 from where it is injected into the cage 3 to sterilize the articles retained therein.

An additive, preferably a washing additive such as soap or detergent, to achieve better washing when used with hot water, is delivered by gravity from an additive container 27. As instructed by the control unit C, the additive control valve 29 may open to release a metered amount of liquid from the additive container 27 to an additive conduit 251, which provides fluid flow communication via an additive inlet 253 coupled to the shell 217, to the sump volume 207. The additive inlet 253 is a simple inlet tube appropriately inserted to pass fluid through the thickness of the shell 217.

Sometimes, more than one additive is desired, such as for example, a disinfectant to be added to unheated rinsing water or to hot water. To that end, more than one additive container 27 is provided, each one with its own additive valve 29, separately controlled by the control unit C. The various additive valves 29 are then coupled in fluid flow communication to a manifold, not shown in the Figs., and released thereby to the additive inlet 253 for addition to the sump volume 207. As an alternative, the manifold is deleted but then, additional additive inlets 253 are required.

Instead of relying on gravity, an additive valve 29 is optionally replaced by a dosage pump, not shown in the Figs., to achieve the same results. Incidentally, this solution is also feasible with the fresh water valve 9, which is then replaced by a dosage pump.

As another option, not shown in the Figs., the additive inlet 253 is possibly coupled to the cyclone assembly 200 at an emplacement other than the shell wall 231, still to introduce additive(s) into the sump volume 207.

As seen in FIGS. 1 and 5, spent water is purged from the sump 19 to the spent water tank 33 via a sump valve 31. A sump outlet 255 is coupled from the bottom of the sump volume 207 to the sump valve 31 and from there to the spent water tank 33. To release spent water to the spent water tank 33, the sump valve 31 is operated by the control unit C, at the end of a treatment cycle or at the end of the treatment.

To empty the spent water tank 33, a plug 35 is removed therefrom to uncover a discharge pipe 37 to which, if desired, a hose, not shown in the Figs., is coupled to evacuate spent water to the drain. Else, the plug 35 is removed and the spent water tank 33 is emptied via the discharge pipe 37. It is evidently feasible to add a valve on the discharge pipe 37, to facilitate emptying, the valve being possibly operated manually. As an alternative, the spent water tank 33 is built as a separate removable unit, for manual retrieval and emptying.

Before operation, the appliance is placed on a stable surface, which is possibly a floor, a chair, a table, a counter-top, or the like. The user must then take care that sufficient fresh water is available in the fresh water tank 7. This means that the volume of fresh water inside the fresh water tank 7 must amount to roughly the contents of three full-length bottles 123, since the treatment of five bottles 123 require between 0.5 liter and 0.75 liter of fresh water.

The fresh water tank 7, which has a closable opening for refill, or is removable from the appliance 100 and replaceable, may be filled with a liquid such as fresh water, or with a treatment solution.

Furthermore, the user must ensure, if so desired, that at least one additive is present, that the spent water tank 33 is able to receive additional spent water, and that the plug 35 is properly mounted. For operation, the appliance is connected to a supply of electricity. The status of readiness of the appliance is possibly displayed on the user interface 117, or control panel 117, which may optionally be equipped with a display and with alarms, visual and or audible. The displays and alarms are not shown in the Figs. but are well known in the art.

As a first step, the appliance is loaded with articles. The pivotal lid 105 and the cage lid 131 are opened, and the articles are inserted into the cage 3. The bottles 123 and 179 are inverted, thus with the bottle bottom 181 up, and secured inside the cage 3 as described above. The accessories are put inside the basket 131, and both the cage lid 131 and the pivotal lid 105 are locked in closed position.

The user then selects a preprogrammed process for the automatic treatment of the articles. It is understood that the controller is pre-programmable, and able to accept any sequence of treatment parameters regarding the number of treatment cycles to be applied, their successive order, possibly their length of duration.

In fact, the controller C is configured for commanding, controlling and sequencing the operations of the appliance 100 and is programmable to command automatic operation of the appliance in treatment step parameters, which parameters define the order of successive treatment cycles, the number of treatment cycles, and the duration treatment cycles.

The appliance 100 is operated from a user interface 117, which is implemented as a control panel, or buttons for operation, or a simple knob. The appliance 100 starts and stops automatically. At the end of the treatment, the articles are retrieved from the appliance.

Typically, the treatment of articles starts with a first treatment cycle, where fresh water is heated to temperature, and released as hot water, for washing the articles with a washing additive. Next comes a second treatment cycle, where the heater is either operated or not, and water is released respectively, heated and unheated, as a liquid for rinsing. Then follows a third treatment cycle, where fresh water is heated to produce and release steam as a fluid for sterilization. The articles are thus treated in a single or in a plurality of treatment cycles, such as washing with hot water, rinsing with unheated water, and sterilizing with steam.

For treatment, fresh water is possibly replaced by a treatment solution, and additives are selected as desired.

Self-treatment calls for the operation of the appliance without the insertion of articles. The same treatment cycles of washing, rinsing and sterilizing apply, with or without additives. In fact, the controller acts in self-treatment exactly as described above for the treatment of articles, with the difference that articles are not inserted into the cage 3, and that one or more different additives are used. Preprogramming of the automatic operation is exactly the same as described above. Nevertheless, the self-treatment cycle may have a different pre-programmed set of operations than a given treatment cycle operating on articles.

It will be appreciated by persons skilled in the art, that the present invention is not limited to what has been particularly shown and described herein above. For example, the appliance is possibly fixedly connected to a water supply pipe and to a drain, for operation on a counter top. The fresh water tank 7 and the spent water tank 33 may thus be removed, or left in place, but the appliance is operated as a static kitchen counter-top unit, receiving fresh water from a water supply pipe and purging spent water to the drain.

Attention is pointed to the fact that the appliance is operative for the treatment of articles by sole consumption of water and at least one additive, so that disposables, such as one or more brushes are superfluous and unnecessary.

In addition, the appliance is possibly adapted to treat at least one bottle 123, less or more than three bottles, or to treat other items in the same way described above. Rather, the scope of the present invention is defined by the appended claims and includes both combinations and subcombinations of the various features described hereinabove as well as variations and modifications thereof which would occur to persons skilled in the art upon reading the foregoing description.

We claim:

1. An article treating apparatus operating in treatment cycles for treating articles, particularly nursing bottles and nursing bottle accessories, wherein each nursing bottle includes a nursing bottle length, a nursing bottle exterior, a nursing bottle bottom, and a nursing bottle mouth fluidly coupled to a nursing bottle interior, the apparatus comprising:

a fresh water tank functioning as a source of fluid for treating the articles independent of a water main, a chamber containing a cage wherein the articles are loaded for treatment with the nursing bottle being disposed upward, the chamber being in fluid communication with and downstream of the fresh water tank, a heater operatively controllable operative to heat the fluid and to produce steam, and a rotator operatively coupled to the cage for rotating the cage in continuous steps of angular rotation and dwell at a dwell station, wherein:

the cage is configured to retain each nursing bottle with the bottom being disposed upward and in controlled-looseness retention allowing limited lengthwise translation and rotation perpendicular to the nursing bottle length, a jet dispenser in fluid communication with and downstream of the fresh water tank, the jet dispenser being configured to produce at least one oblique and intermittent high-speed jet of fluid at a dwell station appropriately aligned to impinge on a spot inside the nursing bottle via the nursing bottle mouth, to slightly lift upward and rotate the bottle, and a removable spent water tank disposed downstream of the chamber for collecting spent waste water, permitting operation of the appliance independent of a sewage system, whereby the apparatus is portable and autonomous by being self-sufficient in fresh water supply and in spent water collection.

2. The article treating apparatus according to claim 1, further comprising:

a distribution of dwell stations operative in association with the jet dispenser and being configured for the at least one high-speed jet of fluid to sequentially impinge on the interior of each nursing bottle at one dwell station, and on the exterior of each nursing bottle at a next dwell station.

3. The article treating apparatus according to claim 1, further comprising:

a distribution of dwell stations operative in association with the jet dispenser and configured for the at least one high-speed jet of fluid to sequentially impinge on the interior of each nursing bottle at one dwell station, and on the nursing bottle accessories at a next dwell station.

4. The article treating apparatus according to claim 1, wherein the treatment cycles comprise:

a washing treatment cycle, where fresh water is either one of both unheated and heated to temperature, and released, respectively, as unheated water and as hot water for washing, a rinsing treatment cycle, where the heater remains either one of both operative and inoperative and water is released respectively, heated and unheated, as a fluid for rinsing, and a sterilization treatment cycle, where fresh water is heated to produce and release steam as a fluid for sterilization, whereby articles in the chamber are treated in either one of both a single and a plurality of treatment cycles, selected alone, and in combination, and in desired order, from the group of treatment cycles consisting of washing as well as rinsing with either one of both unheated and hot water, and sterilizing with steam.

5. The article treating apparatus according to claim 1, wherein:

the cage being of cylindrical and meshed construction to ensure fluid communication between the chamber and the articles and vice versa, the nursing bottles are releasably retained inside the cage in predetermined equally spaced apart circular distribution with the mouth of each nursing bottle being disposed in a downward orientation, and in controlled-looseness retention, the rotator is operatively coupled to the cage for providing controllable cage rotation by advancing the cage in continuous repetitive sequential steps of rotation to one and to a next dwell station and vice versa, with a dwell station for treatment sequentially of the interior of each nursing bottle, and of the nursing bottle accessories and the exterior of each nursing bottle, whereby continuous rotation and dwell of the cage provides enhanced treatment of the nursing bottle accessories and of both the interior and the exterior of each nursing bottle.

6. The article treating apparatus according to claim 5, wherein:

the jet dispenser is disposed downstream of and in fluid communication with the chamber, from which it receives, a succession of doses of fluid supplied thereto for controllably generating at least one intermittent high-speed jet of fluid for injection into the cage, the jet dispenser being aligned in operative association with the cage in opposite oblique orientation relative to the length of a nursing bottle, to sequentially inject the at least one jet of fluid for treatment of the interior of a nursing bottle via the nursing bottle mouth when at one dwell station, and to inject at least one jet of fluid for treatment of the exterior of the nursing bottle and of the nursing bottle accessories when at a next dwell station, whereby doses of fluid and intermittent doses of at least one high-speed jet of fluid save fresh water and enhance treatment efficiency, and a filter is intermediately mounted in the chamber and the jet dispenser, for filtering fluid received from the chamber before repeated use of filtered fluid by the jet dispenser, the filter enabling repeated use of a dose of fluid, whereby doses of fresh water necessary for treatment of articles are saved, permitting reduction of size of the fresh water tank and of the wastewater tank, to make the appliance portable.

7. The article treating apparatus according to claim 6, further comprising:

at least one high-speed intermittent jet of fluid obliquely impinging on the interior of a nursing bottle and causing thereto longitudinal displacement and angular displacement perpendicular to the length of the nursing bottle, whereby at least one high-speed jet of fluid successively impinges on different spots inside the nursing bottle and enhances treatment solely by fluid treatment.

8. The article treating apparatus according to claim 6, further comprising:

a basket of cylindrical and meshed construction to ensure fluid communication between the chamber and the articles and vice versa, the basket being disposed inside the cage, inside which the nursing bottle accessories are dispersed and retained in random distribution, and a distribution of dwell stations configured to have the at least one high-speed jets of fluid sequentially impinge on the nursing bottle accessories at one out of two dwell stations.

9. The article treating apparatus according to claim 6, wherein the jet dispenser generates a plurality of high-speed jets of fluid selected alone and in combination from the group of intermittent and of continuous jets of fluid.

10. The article treating apparatus according to claim 1, wherein:

the heater is located at either one of both an inside of the jet dispenser and adjacent the jet dispenser.

11. The article treating apparatus according to claim 1, further comprising:

a controller for commanding, controlling and sequencing operation of the apparatus, the controller being programmable to command automatic operation of the apparatus in treatment step parameters, selected alone or in combination with the parameters consisting of order of successive treatment cycles, number of treatment cycles, and duration of treatment cycles.

12. The article treating apparatus according to claim 1, wherein:

a volume of water contained in the fresh water tank is in the range of 0.5 liter and 0.75 liter which is sufficient for treatment of up to five nursing bottles and nursing bottle accessories, whereby the appliance is capable of treating more than one load of articles and remains a portable appliance.

13. The article treating apparatus according to claim 1, wherein the spent water tank is removable from the appliance for emptying, and is replaceable.

14. The article treating apparatus according to claim 1, further comprising:

a self-treatment process operatively controllable to provide at least either one of both a single and a plurality of treatment cycles, selected alone and in combination, from the group of treatment cycles consisting of washing with either one of both cold and hot water, of rinsing with either one of both cold and hot water, and of sterilizing with steam, in a selectable order and number of cycles.

15. The article treating apparatus according to claim 1, further comprising:

at least one additive container from which an additive is controllably released, the at least one additive container being coupled in fluid communication and appropriately configured for adding the at least one additive to the self-treatment process, whereby the self-treatment process is enhanced.

16. An article treating apparatus for treating articles, namely nursing bottles and nursing bottle accessories, wherein each nursing bottle includes a nursing bottle length, a nursing bottle exterior, a nursing bottle bottom, and a nursing bottle mouth fluidly coupled to a nursing bottle interior, operating within a housing of compact dimensions, comprising:

a fresh water tank functioning as a source of fluid for treating the articles independent of a water main, a chamber containing a cage wherein the articles are loaded for treatment with the nursing bottle bottom being disposed upward, the chamber being in fluid communication with and downstream of the fresh water tank, a heater operatively controllable to heat the fluid and to produce steam, and a rotator operatively coupled to the cage for rotating the cage in continuous steps of angular rotation and dwell at a dwell station, wherein:

the cage is configured to retain each nursing bottle in controlled-looseness retention for limited lengthwise translation and rotation perpendicular to the nursing bottle length, a jet dispenser in fluid communication with and downstream of the fresh water tank, the jet dispenser being configured to produce at least one oblique and intermittent high-speed jet of fluid at a dwell station in appropriate alignment to impinge on a spot inside the nursing bottle via the nursing bottle mouth, to slightly lift upward and rotate the bottle, and a removable spent water tank downstream of the chamber for collecting spent waste water, permitting operation of the appliance independent of a sewage system, whereby the apparatus is portable and autonomous by being self-sufficient in fresh water supply and in spent water collection.

17. The article treating apparatus according to claim 16, wherein:

the fresh water tank is filled with fresh water for controllable retrieval therefrom of a plurality of successive restricted and measured doses of fresh water for the treatment of the articles, and is configured to permit operation of the appliance independently of an external water source, a dosing device located downstream of the fresh water tank configured for controllably releasing at least one dose of measured and of restricted volume of fresh water, the heater being disposed downstream of the fresh water tank is operatively controllable to heat fresh water for treatment of the articles, and the chamber for treating articles therein is in fluid communication with and downstream of the dosing device, whereby the appliance is autonomous for treatment of articles by being self-sufficient in fresh water supply and in spent water collection.

18. The article treating apparatus according to claim 16, wherein:

a cage is received within the chamber and configured for containing the articles inserted into the appliance for treatment, the cage being of cylindrical and meshed construction to ensure fluid communication between the chamber and the articles and vice versa, the nursing bottles being held inside the cage in predetermined equally spaced apart circular distribution with the mouth of each nursing bottle being disposed in a downward orientation, and in controlled-looseness retention, and the rotator is operatively coupled to advance the cage in controlled continuous repetitive sequential steps of rotation and of dwell for sequential treatment of the interior of the nursing bottles, and of the nursing bottle accessories and the exterior of the nursing bottles, whereby continuous rotation and dwell of the cage provides enhanced treatment of the accessories and of both the exterior and the interior of the nursing bottles.

19. The article treating apparatus according to claim 16, wherein:

the jet dispenser is disposed downstream of and in fluid communication with the chamber, from which it receives a succession of doses of fluid supplied thereto for controllably generating at least one intermittent high-speed jet of fluid for injection into the cage, the jet dispenser being aligned in operative association with the cage in opposite oblique orientation relative to the length of a nursing bottle, to inject the at least one jet of fluid for treatment of the interior of a nursing bottle via the nursing bottle mouth when at one dwell station, and to inject at least one jet of fluid for treatment of the exterior of the nursing bottles and of the nursing bottle accessories when at a next dwell station, whereby doses of fluid and the at least one intermittent high-speed jet of fluid save fresh water and enhance treatment efficiency, and a filter is disposed intermediate the chamber and the jet dispenser, for filtering fluid received from the chamber before repeated use of filtered fluid by the jet dispenser, the filter enabling repeated use of a dose of fluid, whereby doses of fresh water necessary for treatment of articles are saved, permitting reduction of size of the fresh water tank and of the wastewater tank, to make the appliance portable.

20. The article treating apparatus according to claim 19, wherein:

at least one high-speed intermittent jet of fluid obliquely impinging on the interior of a nursing bottle and causes thereto longitudinal displacement and angular displacement in perpendicular to the length of the nursing bottle, whereby at least one high-speed jet impinges successively on different spots of the nursing bottle interior and enhances treatment.

21. The article treating apparatus according to claim 16, wherein:

the heater is disposed at a location selected from the group of locations consisting of inside the dose holder, inside the jet dispenser, and adjacent the jet dispenser.

* * * * *